US008809666B1

(12) United States Patent
Liu

(10) Patent No.: US 8,809,666 B1
(45) Date of Patent: Aug. 19, 2014

(54) ELECTRONIC DRUM INDUCTION STRUCTURE

(71) Applicant: Tzu-Chen Liu, Keelung (TW)

(72) Inventor: Tzu-Chen Liu, Keelung (TW)

( * ) Notice: Subject to any disclaimer, the term of this patent is extended or adjusted under 35 U.S.C. 154(b) by 0 days.

(21) Appl. No.: 13/798,096

(22) Filed: Mar. 13, 2013

(51) Int. Cl.

| | |
|---|---|
| ***G10H 3/14*** | (2006.01) |
| ***G10H 3/00*** | (2006.01) |
| ***G10H 1/32*** | (2006.01) |
| ***G10D 13/02*** | (2006.01) |
| ***G10H 3/08*** | (2006.01) |

(52) U.S. Cl.

CPC ..... *G10H 3/08* (2013.01); *G10H 3/146* (2013.01); *G10H 3/00* (2013.01); *G10H 3/14* (2013.01); *G10D 13/027* (2013.01); *G10D 13/024* (2013.01); *G10H 1/32* (2013.01); *G10D 13/02* (2013.01)

USPC ..... 84/725; 84/411 R; 84/723; 84/743

(58) Field of Classification Search

CPC ... G10D 13/024; G10D 13/02; G10D 13/027; G10H 3/146; G10H 3/14; G10H 3/00; G10H 1/32; G10H 3/08

USPC ..... 84/725, 411 R, 723, 743

See application file for complete search history.

(56) References Cited

U.S. PATENT DOCUMENTS

| | | | | |
|---|---|---|---|---|
| 4,279,188 | A * | 7/1981 | Scott | 84/723 |
| 5,042,356 | A * | 8/1991 | Karch | 84/725 |
| 7,135,630 | B2 * | 11/2006 | Maruhashi et al. | 84/411 P |
| 7,667,130 | B2 * | 2/2010 | Mishima | 84/723 |
| 7,932,452 | B2 * | 4/2011 | Chen | 84/411 R |
| 8,039,724 | B1 * | 10/2011 | Norman et al. | 84/743 |
| 8,148,617 | B2 * | 4/2012 | Hashimoto et al. | 84/411 P |
| 2003/0037660 | A1 * | 2/2003 | Suenaga | 84/411 R |
| 2007/0051231 | A1 * | 3/2007 | Fujii | 84/723 |
| 2008/0127803 | A1 * | 6/2008 | Liu | 84/411 R |
| 2009/0151475 | A1 * | 6/2009 | Masaki et al. | 73/862.68 |
| 2013/0098227 | A1 * | 4/2013 | Wei | 84/723 |
| 2013/0112068 | A1 * | 5/2013 | Rogers | 84/723 |

FOREIGN PATENT DOCUMENTS

CN 101853657 A * 10/2010

* cited by examiner

*Primary Examiner* — David Warren
*Assistant Examiner* — Christina Russell
(74) *Attorney, Agent, or Firm* — Leong C. Lei

(57) ABSTRACT

The present invention relates to an electronic drum induction structure, and more particularly to a structure eliminating noise generated from a drumhead of an electronic drum so as to transmit electronic induction sound only. The electronic drum induction structure of the present invention is mainly formed by combining an induction ring with a woven net, where the induction ring is an annular foam, inside which an induction sheet is sandwiched, and an induction signal line is connected; the woven net is formed by weaving resin fibers, and an induction ring is attached on the rear face of the woven net at the inner diameter of the circumference thereof.

1 Claim, 1 Drawing Sheet

ELECTRONIC DRUM INDUCTION STRUCTURE

(a) TECHNICAL FIELD OF THE INVENTION

The present invention generally relates to an electronic drum induction structure, and more particularly to a structure for eliminating noise generated from an electronic drum drumhead, and transmitting electronic induction sound simply.

(b) DESCRIPTION OF THE PRIOR ART

In conventional electronic induction percussion instruments, an inductor is positioned on the center of the rear side of a beaten face, thereby capturing and inducting beating strength, transmitting it to a computer memory, selecting the sounds stored in the memory, and finally, emitting proper sounds from a loudspeaker. However, the beaten face, i.e. a drumhead, is adopted with a plastic disc face, and a double-sound source is caused due to sounds emitted from the beaten face itself such that noise is generated, if, alternatively, a rubber disc face is adopted, the sounds emitted from the beaten face itself is reduced, but it is still unable to eliminate double-source source noise.

Referring to FIG. 1, which is a schematic cross-sectional view of a conventional electronic drum, in an electronic drum 10, an inductor 11 thereof is positioned on a center below a drumhead 12, where the inductor 11 is supported by an inner drum rack 13, and the drumhead 12 is then hitched up and retained on an external drum rack 15 by a circular metal frame 14. Not only the drumhead 12 emits sound by itself, but the inductor 11 is also touched, the sound will be transmitted to a computer through a signal line 17, the sound after the electronic induction will be emitted from a loudspeaker because the drumhead 12 is a solid face when the drumstick 16 beats and exerts force on the drumhead 12, but, it therefore generates both the drumhead sound and electronic induction sound such that noise is generated.

SUMMARY OF THE INVENTION

To improve the deficit mentioned above, solve the noise issue, and purify the electronic induction sound, the present invention is proposed.

An electronic drum induction structure of the present invention takes the situations mentioned above into consideration, not only elimination of the beating and rebounding vibration sound from a drumhead is achieved by the sound absorption of a ventilation structure of the drumhead, but a net plate woven with resin fibers is adopted to form the drumhead under the consideration of durability, moisture resistance and elasticity.

An electronic drum induction structure of the present invention mulls over that beaten points of a drumhead are generally positioned on not too far locations away from the center, and the not too far locations away from the center are apt to be exerted with force to form rippling wave motion. Therefore, forces are accumulated at the same time to touch an induction ring sharply, causing beating signals to emit saturate induction sound after wave motion originated from the center is transmitted to the induction ring attached on a rear face of an external edge.

An electronic drum induction structure of the present invention is formed by combining an induction ring with a woven net, where the induction ring is an annular foam, inside which an induction sheet is sandwiched, and an induction signal line is connected.

An electronic drum induction structure of the present invention is formed by combining an induction ring with a woven net, where the woven net is formed by weaving resin fibers, and an induction ring is attached on the inner diameter of the circumference of the rear face of the woven net.

DETAILED DESCRIPTION OF THE PREFERRED EMBODIMENTS

Figure 1:
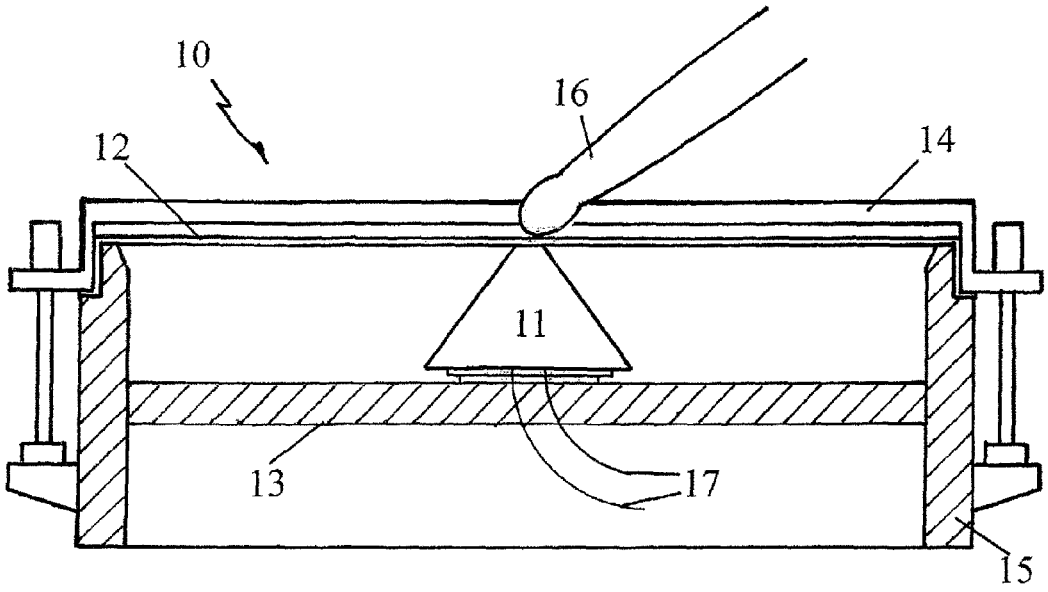
FIG.1 PRIOR ART
FIG. 1 is a cross sectional view of a conventional electronic drum structure.
Figure 2:
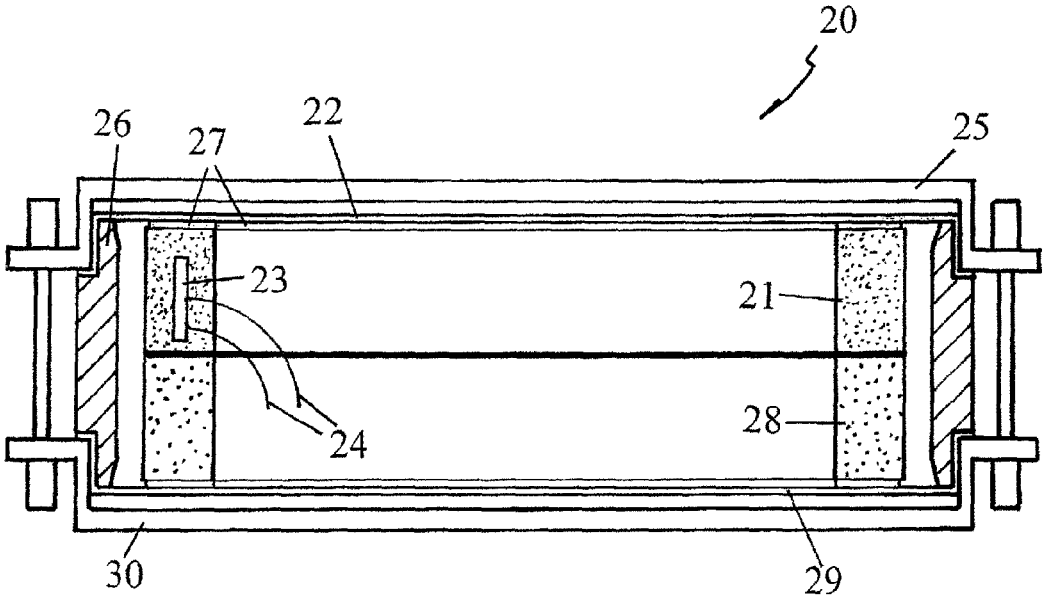
FIG. 2 is a cross sectional view of an electronic drum structure of the present invention.

Referring to FIG. 2, which is a cross sectional view of an electronic drum structure according to the present invention, an induction structure for an electronic drum 20 is formed by combining an induction ring 21 with a woven net 22, where the induction ring 21 is an annular foam, inside which an induction sheet 23 is sandwiched. The induction sheet 23 is connected with an induction signal line 24. The woven net 22 is formed by weaving resin fibers. Furthermore, the induction ring 21 is attached on the inner diameter of the circumference of the rear face of the woven net 22.

The ventilating woven net 22 is hitched up and retained on an electronic drum framing set 26 by a top metal frame 25. Not only to absorb beating vibration sound to prevent the generation of noise, but to mull over durability, moisture-resistance and elasticity, the woven net 22 is a net formed by weaving resin fibers.

The induction ring 21 is configured on the rear face of the woven net 22 inside the circumference thereof through an adhesive layer 27. Because the induction ring 21 is an annular foam and the induction sheet 23 is sandwiched therein, the induction sheet 23 can fully sense the vibration of the entire annular foam. Therefore, rippling wave power is easy to be collected through the induction sheet 23 when beaten points are fallen on the center of the woven net 22, thereby transmitting it clearly to the induction ring 21 attached on the rear face of the circumference and emitting sharp and full induction sound.

A layer of annular foam 28 is further padded below the induction ring 21 inside the electronic drum framing set 26, supported by a bottom woven net 29 but no induction sheet 23 configured therein. Furthermore, a bottom metal frame 30 is operated into coordination with the above original top frame 25 to clip and retain the bottom woven net 29 on the electronic framing set 26 similarly.

I claim:

1. An electronic drum induction structure, formed by combining an induction ring with a woven net;

wherein, said induction ring is an annular foam, and an induction sheet is sandwiched therein and connected with an induction signal line; said woven net comprises resin fibers interconnected to form a ventilating net, and said induction ring is attached to an inner diameter of a circumference of a rear face of the woven net; and a hollow interior is circumferentially delimited by the annular foam of the induction ring and the woven net is supported over the hollow interior by the induction ring.

* * * * *